United States Patent [19]

Parker et al.

[11] 4,067,295

[45] Jan. 10, 1978

[54] MAGNETIC MICROFIELD DONOR SYSTEM

[75] Inventors: Delmer G. Parker, Irondequoit; Lawrence J. Fraser, Rochester; Joseph L. Scaletta, Henrietta, all of N.Y.

[73] Assignee: Xerox Corporation, Stamford, Conn.

[21] Appl. No.: 705,974

[22] Filed: July 16, 1976

Related U.S. Application Data

[62] Division of Ser. No. 556,249, March 7, 1975, abandoned.

[51] Int. Cl.[2] ..... G03G 15/08; G03G 15/09

[52] U.S. Cl. ..... 118/653; 118/657; 355/3 DD; 428/18

[58] Field of Search ..... 118/647, 653, 657, 658; 355/3 DD; 427/18, 14; 96/150

[56] References Cited

U.S. PATENT DOCUMENTS

| | | | |
|---|---|---|---|
| 3,415,224 | 12/1968 | Hudson | 118/657 X |
| 3,584,601 | 6/1971 | Turner | 427/18 X |
| 3,601,091 | 8/1971 | Preckshot | 427/18 X |
| 3,759,222 | 9/1973 | Maksymiak et al. | 118/653 X |
| 3,914,460 | 10/1975 | Maksymiak | 118/647 X |
| 3,998,185 | 12/1976 | Weiler | 355/3 DD |

FOREIGN PATENT DOCUMENTS

| | | | |
|---|---|---|---|
| 1,196,962 | 7/1965 | Germany | 427/18 |
| 47-14677 | 5/1972 | Japan | 118/657 |

*Primary Examiner*—James Kee Chi

*Attorney, Agent, or Firm*—James J. Ralabate; James P. O'Sullivan; George J. Cannon

[57] ABSTRACT

A magnetizable donor is magnetized to define a microfield with a characteristic spacing between pole centers of about 0.010 inches. The strong short range fields between poles pick up and hold a thin uniform and continuous layer of magnetic toner. The layer of toner is then electrostatically charged and brought into close proximity to a receptor, without touching the same, where only latent image areas of the receptor attract toner from the donor layer.

4 Claims, 4 Drawing Figures

MAGNETIC MICROFIELD DONOR SYSTEM

This is a division of application Ser. No. 556,249, filed Mar. 7, 1975 now abandoned.

BACKGROUND OF THE INVENTION

This invention is in the field of electrostatic xerography and relates particularly to the application of toner to a receptor member.

In electrostatic xerography what is known as "spaced touchdown" donor development has a number of appealing characteristics. Among these are the potential for developing clean images at high speed the elimination of carrier beads from the developer and the reduction in the amount of developer required to be transported. In the absence of carrier beads, the associated bulk, mixing and developer life problems are avoided. In its simplest form, a touchdown development system consists of a donor surface on to which the developer (toner) is attached, electrostatically charged, and then transported to, and through the development zone, usually at a speed synchronous with the image bearing surface being developed.

In the past, several means have been utilized to attach toner to a donor means in spaced touchdown development method. Such means include adhesive, electrostatic, or mechanical force. Charging by means of a corona discharge device is the most common method of imparting a charge to toner but contact charging has also been employed.

A donor can be brought into contact with the surface bearing the electrostatic latent image during development but the preferred technique is to bring the donor into close proximity to the photoreceptor, usually at a distance of from about 0.005 inch to about 0.010 inch. Since any toner must be pulled across the gap by the image field, the background regions will be kept exceptionally free of spurious toner deposits. Maintaining a gap of from about 0.005 inch to about 0.010 inch between the donor and the image bearing surface is a difficult problem due to the mechanical tolerances of the donor system's components. Any variation in the thickness of the toner layer on the donor tend to aggravate this problem.

In the past, in order to keep these variations within acceptable limits it has often been necessary to level the toner with a doctor blade. However, a doctor blade has the undesirable feature that it can compact the toner to the point where its mobility in the electric development field is impaired. Encapsulated toner which is fragile or easily ruptured may also be crushed or fractured during the leveling operation. Since some toner compaction is inevitable during charging and development, it is often desirable to remove all toner and renew the surface of the donor with fresh toner after each cycle. (If the donor is of the adhesive type, it is usually discarded with the unused toner.) Donors which employ electrostatic force to hold the toner have recycling problems because it is difficult to completely neutralize the residual charge on the donor surface beneath the toner. Another problem in the employment of electrostatic force to retain toner on a donor, is the delicate balance which must be maintained to insure consistent toner adhesion and transport in cyclic operation. This balance has proven to be difficult to achieve in practice.

An alternative method of bonding toner to the donor, and one that has the advantage that the nature of the bonding force is different from the development forces, is to use a magnetized donor surface and a magnetically attractable toner. Toner can be made magnetically tractable if it is impregnated with a ferrous material such as iron oxide. The magnetic donor development schemes suggested in the past have been impractical for several different reasons. For example, it has been proposed that a magnetized donor member be employed to hold magnetic tonor thereon and to move that toner to a receptor member having a latent electrostatic image thereon. However, in all such previous proposals, the magnetic field pattern on the donors have been arranged to cause the toner to stand outwardly therefrom in the form of bristles of a brush. Such bristles or brush-like formations were wiped over the receptor member and the charged image areas thereon would attract and hold the toner material. However, those upstanding formations of the toner brushed over the entire surface of the receptor often result in darkened or smudged background areas.

SUMMARY OF THE INVENTON

The present invention contemplates a magnetized donor wherein the magnetic field is very close to the donor surface to hold thereon a uniform thin layer of toner that can be positioned closely adjacent but spaced from a receptor surface. The invention results in eliminating all compaction of the toner by leveling blades or the like and provides for spaced touchdown development with improved background quality. In general, the magnetized donor is provided with a magnetic microfield at its surface, as will be described in greater detail.

DESCRIPTION OF THE PREFERRED EMBODIMENTS

Figure 1:
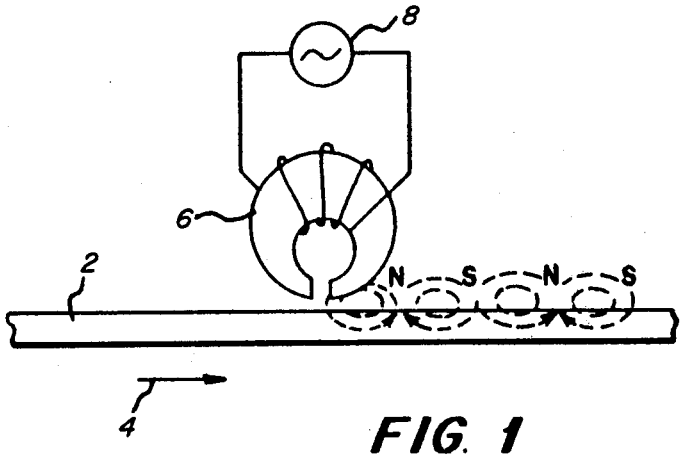
FIGS. 1 and 2 are enlarged schematic views illustrating the manner of magnetizing a donor and a representation of the donor member with the magnetic poles indicated thereon.
Figure 2:
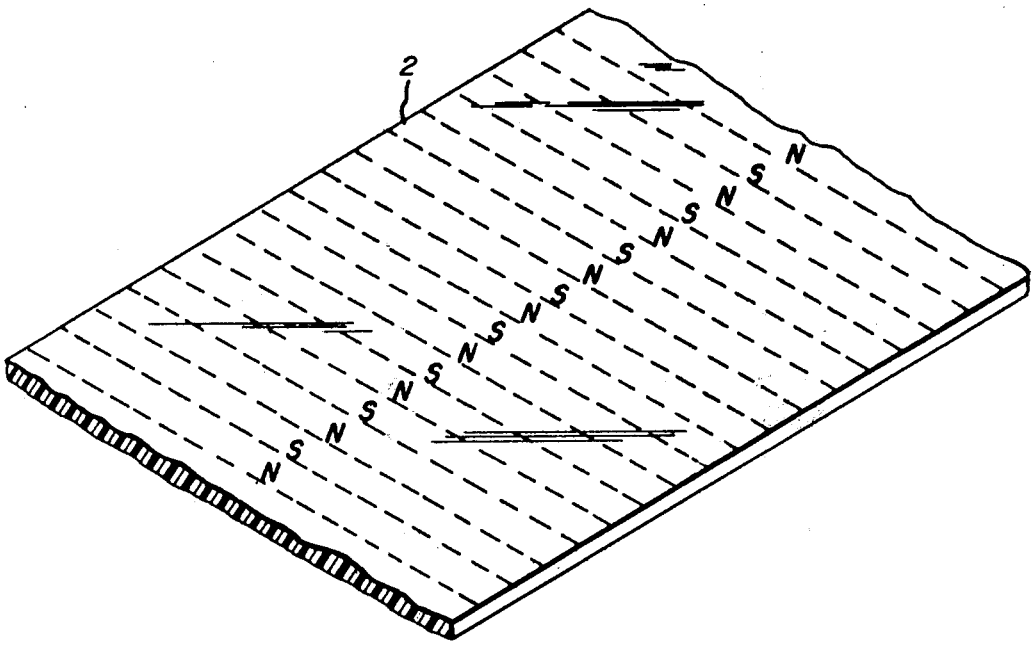

In FIG. 1, numeral 2 represents a magnetizable donor member movable in the direction of arrow 4 past a magnetizing head 6. The magnetizing head 6 is energized by a source 8 of alternating current and results in magnetizing the donor 2 with alternate magnetic poles, as indicated in FIG. 1. The speed of advance of the donor 2 past the magnetizing head 6 is so related to the frequency of the AC source that the spacing between adjacent magnetic poles is preferably of the order of about 0.010 inch. The donor member 2 may be in the form of a magnetic tape with the magnetizing head 6 being of such construction that it extends across the width thereof to provide magnetic poles extending across the tape, as suggested by the broken lines of FIG. 2. Reference to a tape is merely by way of illustration since any other magnetizable member, either flexible or rigid, may be employed.

Figure 3:
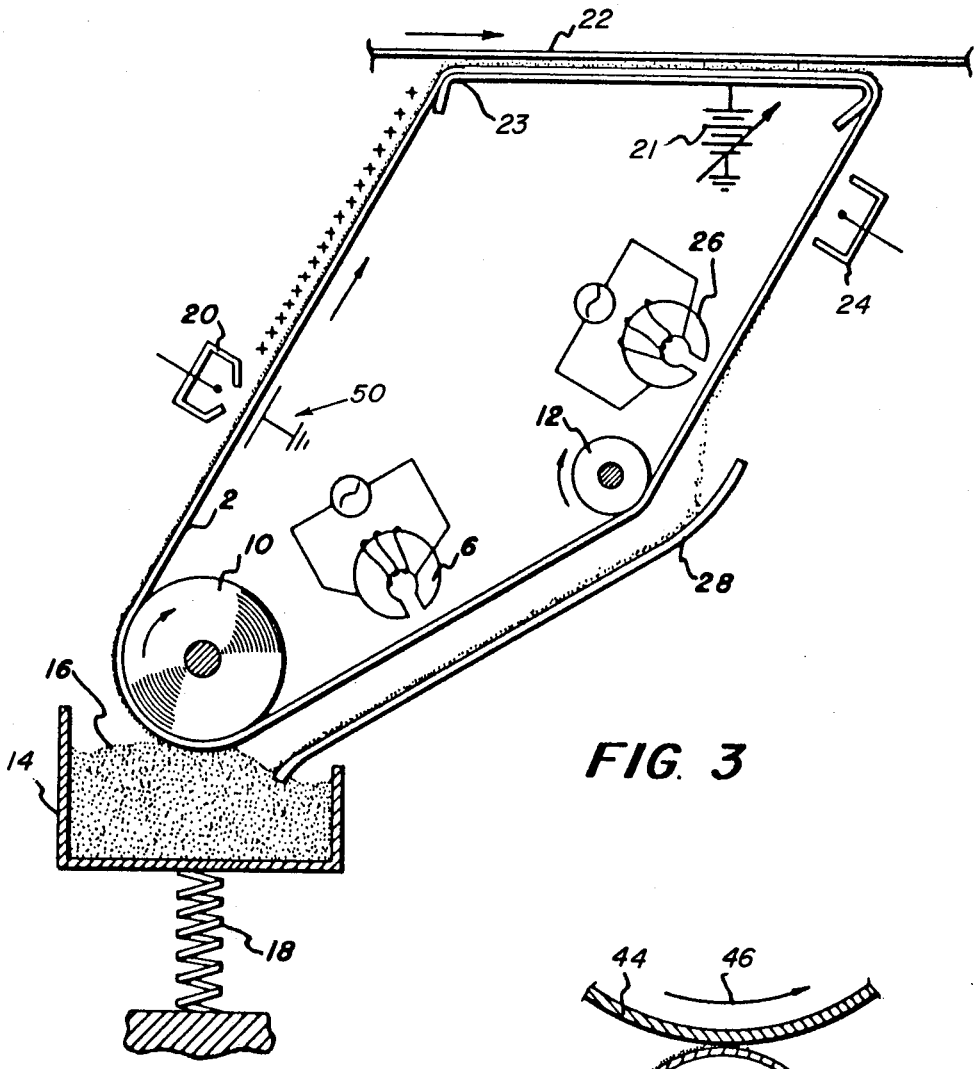
FIG. 3 is a schematic view of one form of apparatus employing the present invention.

FIG. 3 schematically shows an arrangement embodying the present invention wherein the donor member 2 is in the form of an endless magnetizable tape trained over suitable guiding and driving rollers 10 and 12 and over a fixed shoe 23. Shoe 23, in one embodiment, is subjected to a specified bias to aid development. Since the present invention readily lends itself to the use of the magnetic tape or tape-like donor members, great flexibility is provided for designing convenient machine configurations. The magnetizing head 6, such as the head described with reference to FIG. 1, is positioned adjacent the path of movement of the donor member 2 to provide the micromagnetic field thereon and the tape is then trained over pulley 10 which extends downwardly into a hopper 14 containing magnetic toner material 16. The toner material may be any toner capable of being rendered magnetically attractable. A particulate toner may be rendered magnetically attractable by impregnating the same with a suitable ferrous material, such as iron oxide, but not in sufficient quantities as to render the toner conductive. Preferably, the hopper 14 is constantly mechanically vibrated, by suitable means represented at 18, to maintain the toner material in a fluent state. A flow control agent may also be included with the toner. Such agents are preferably hydrophobic silica such as Cabosil M-5 fumed silica commercially available from the Cabot Chemical Co., Boston, Mass., Organ-O-Sil S-5 and Aerosil from Degussa, Inc., N.Y., N.Y.

Alternatively a mixed toner may be employed comprising a magnetically tractable powder carrier and an electroscopic, non-magnetically tractable toner component. The electroscopic toner component is the typical, commercially available xerographic toner which is a plastic material impregnated with a colorant. The magnetically tractable toner component is that described above. The particle size of each component is substantially the same and each toner is selected so as to be considerably apart in the triboelectric series.

In operation, the electroscopic toner component electrostatically adheres to the magnetically tractable toner component and is thus carried onto the magnetized donor together with the magnetically tractable component. In the development zone, the force fields of the electrostatic latent image removes the electroscopic toner component from the magnetically tractable powder component. Since the magnetically tractable powder is of the same charge polarity as the latent image it is repelled from the image areas. The electrostatic attraction between the electroscopic toner and the magnetically tractable toner further aids in preventing unwanted background development by providing a force on the toner opposite in direction to the image bearing substrate. By employing a mixed tonor in the process of this invention, an electrostatic latent image can be developed with an electroscopic toner without the usual large carrier bead in the developer. Furthermore, such a mixed toner eliminates the need to apply an electrostatic charge on the toner material by means cuch as a corona discharge device as will be more fully explained below.

The magnetized donor 2 moves into the hopper in close proximity or in contact with the toner material 16 therein and a layer of toner material is attracted to and held by the magnetized tape. In view of the small distance between the magnetic pole centers, it is found that the toner forms a layer on the donor of uniform thickness of from one to two mils thick. The limited thickness of the toner layer on the donor is probably caused by the magnetic shunting effect of the toner and the limited range of the magnetic field resulting from the close spacing between poles. It is found that the pattern of the magnetic poles does not appear in the layer of toner, the latter being uniform throughout. It has also been found that no means are necessary to render the layer of toner of uniform thickness, such as doctor blades or the like, since the self-limiting loading characteristic of the magnetic microfield eliminates all need for a leveling blade.

As the donor member 2 progresses along its path of movement, it is caused to pass between the high voltage corotron device 20 and biased plate 50 which places an electrostatic charge on the toner material. Preferably, donor 2 is electrically conductive. Alternatively, the surface of donor 2 is treated such as by an aqueous solution of colloidal graphite, to render it conductive to thus act as an electrode. The donor is then directed over the fixed shoe 23 so that its path of movement and its position can be accurately and precisely controlled to be spaced a predetermined small distance from the surface of a photoreceptor 22, movable in synchronism therewith. As is known, the photoreceptor will have a latent electrostatic image thereon and the charged image portions will attract and hold the charged toner material to develop the image. When donor 2 is nonconductive, power supply 21 is employed to place a bias on shoe 23. Such bias is typically equal to or slightly greater than the background potential of the photoreceptor 22. Improved results are obtained by applying a pulsed bias to shoe 23. Alternatively, shoe 23 may be connected to a ground source. The photoreceptor may be a charged paper on which the image is permanently developed or it may be a transfer device adapted to deposit its development image on paper or other material. The spacing between the lower surface of the photoreceptor and the upper surface of the donor member resting on shoe 23 is greater than the thickness of the layer of toner material so that none of the toner engages background areas of the receptor, that is, areas on which no image appears and thus a clean background can be maintained. Preferably, the spacing between the layer of toner and the surface of receptor is on the order of about 0.005 inch to about 0.010 inch. Obviously, means (not shown) must be provided to maintain the receptor 22 accurately spaced from the shoe 14. When receptor 22 is in the form of a belt or the like, a vacuum platen could be employed to maintain the proper spacing.

After the donor 2 travels over shoe 23 it passes a high voltage neutralizing corotron 24 which neutralizes the electrostatic charge on the toner material. Thereafter, the donor passes an erasing or demagnetizing head 26 which demagnetizes the donor member and thus releases the toner therefrom. As shown, a suitable means 2B is provided to receive the released toner and direct the same back to the hopper 14. After the unused toner is released from the donor, the latter again passes the magnetizing head 6 and the foregoing described cycle may be repeated.

Figure 4:
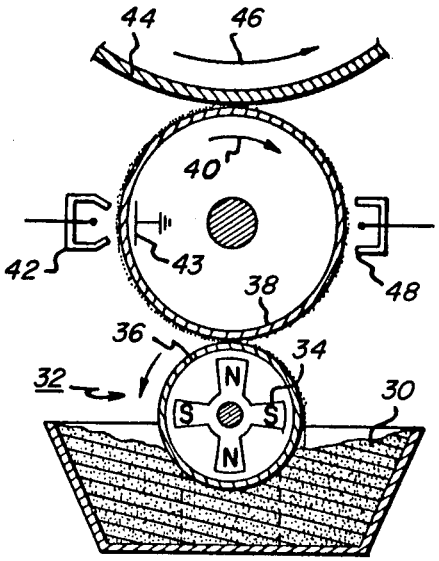
FIG. 4 is a fragmentary schematic view of an alternative embodiment.

FIG. 4 illustrates a further embodiment wherein a container 30 holds a supply of magnetic toner. In this form of the invention, a magnetic brush device 32 comprises a rotating permanent magnet 34 rotating in the direction indicated by the arrow, within a stationary cylinder 36 of stainless steel. The motion of the magnet causes the magnetic toner to travel around the outside of the cylinder in a direction opposite to the rotation of the magnet. Tumbling action of the toner as it flows around the cylinder is such that agglomerates tend to be broken up and the toner appears to behave like a fluid. As the toner progresses to the top of the cylinder 36, it is brought into proximity to the surface of a permanently magnetized rigid rotary donor 38. The outer periphery of which is provided with a micromagnetic field such as that described with reference to FIGS. 1 and 2. The donor 38 is caused to rotate in the direction of arrow 40, and the toner thereon is caused to pass between a high voltage corotron 42 and biased plate 43 which impresses an electrostatic charge on the toner material. The donor 38 rotates to carry its electrostatically charged toner to a position adjacent the surface of a photoreceptor 44, also movable in the direction of the arrow indicated at 46. As in the previous embodiment, the photoreceptor 44 will have a latent electrostatic image thereon, the charged image areas of which will attract and hold toner material from the donor 38. Continued rotation of the donor 38 passes the unused toner thereon adjacent a neutralizing corotron 48 to neutralize any remaining charge on the toner and the donor continues to rotate, moving past the magnetic brush 32 whereupon the supply of toner material on the drum 38 is replenished and the described cycle is repeated.

As in the previous embodiment, the magnetic microfield on donor 38 insures a thin uniform layer of toner without the use of leveling blades.

The material of the donor 38 must not only be capable of being permanently magnetized but it must also have a high coercive force, otherwise the spinning magnet 34 would tend to erase the magnetic microfield from the donor. A suitable material is commercially available under the trade name "Plastiform" from the 3M Company.

While a limited number of specific embodiments of the invention are shown and described herein, it is to be understood that they are merely illustrative of the principles involved and that other forms may be resorted to within the scope of the appended claims.

We claim:

1. An apparatus for developing a latent electrostatic image on a receptor member by directing toner material thereto, comprising:

a magnetically recordable donor member having a path of travel spaced apart from said receptor member by a distance of from about 0.005 to about 0.010 inches; means for magnetically recording a multiplicity of magnetic poles on said magnetically recordable donor member, adjacent magnetic poles being spaced apart on the order of about 0.010 inches and of opposite magnetic polarity; means for contacting the magnetically recorded donor member with magnetic toner to form thereon an about 1 to about 2 mils thick uniform layer of magnetic toner on said magnetically recorded donor member; and means for substantially uniformly maintaining the separation distance of from about 0.005 to about 0.010 inches between said receptor member and said donor member to define a development zone.

2. The apparatus of claim 1 further including means for magnetically erasing said magnetically recordable donor member intermediate said development zone and said magnetic recording means.

3. The apparatus of claim 2 further including means for neutralizing electrostatic charge on toner borne by said magnetically recordable donor member intermediate said development zone and said magnetic erasing means.

4. The apparatus of claim 3 further including means for electrostatically charging toner material borne by said magnetically recordable donor member intermediate said development zone and said means for contacting said magnetically recordable donor member with magnetic toner.

* * * * *